US006022130A

United States Patent [19]

Donato

[11] Patent Number: 6,022,130

[45] Date of Patent: Feb. 8, 2000

[54] MODULAR CONSTRUCTION TRACK LIGHTING FIXTURE

[75] Inventor: Anthony C. Donato, Wellesley, Mass.

[73] Assignee: Lightolier Division of the Genlyte Group, Inc., Fall River, Mass.

[21] Appl. No.: 09/149,778

[22] Filed: Sep. 8, 1998

[51] Int. Cl.[7] ..... F21V 21/30

[52] U.S. Cl. ..... 362/428; 362/427

[58] Field of Search ..... 362/404, 427, 362/428, 430, 265, 437, 434

[56] References Cited

U.S. PATENT DOCUMENTS

| | | | |
|---|---|---|---|
| 4,258,413 | 3/1981 | Mausser | 362/427 X |
| 4,731,710 | 3/1988 | Distasio | 362/404 X |
| 5,140,507 | 8/1992 | Harwood | 362/428 X |
| 5,655,833 | 8/1997 | Raczynski | 362/430 X |
| 5,871,274 | 2/1999 | Lee et al. | 362/427 X |

*Primary Examiner*—Laura K. Tso

*Attorney, Agent, or Firm*—Hopgood, Calimafde, Kalil & Judlowe, LLP

[57] ABSTRACT

A track lighting fixture includes a receptacle that can be used with a wide variety of lamp enclosures of different configurations and sizes. The fixture includes an L-shaped bracket adapted to be pivotably mounted by means of a stem to a track. The fixture further includes a lamp socket in its interior and a docking bulkhead that includes a bayonet mount which receives a mating bayonet mount in the lamp enclosure. In another aspect of the invention, an opening is provided in the L-shaped bracket through which the end of a hand-held pole may be inserted to engage the fixture, so that by manipulation of the pole the angle and horizontal attitude of the fixture can be accurately adjusted by an individual from the floor without the need for that individual to risk injury by standing on a chair or ladder.

3 Claims, 5 Drawing Sheets

MODULAR CONSTRUCTION TRACK LIGHTING FIXTURE

BACKGROUND OF THE INVENTION

The present invention relates generally to lighting fixtures, and more particularly to a track lighting fixture that can readily accommodate different types of light sources having different configurations and styles and which is capable of producing a variety of different lighting effects.

Track lighting fixtures are in widespread use in residences and commercial institutions. In a typical track lighting fixture, a track is secured within the ceiling and a mounting stem is secured by a track adapter to, and extends downward from, the track. A lighting fixture is mounted to the lower end of the stem at a swivel mechanism and a lamp surrounded by a lamp housing or enclosure is mounted in a socket in the interior of the fixture. The angular orientation of the lamp housing relative to the track mounting stem can be set or aimed at the time of the installation of the fixture so as to produce the desired illumination pattern.

The known track lighting fixtures are, however, limited in their ability to accommodate a wide variety of lamp enclosures, thereby limiting the variety of enclosure styles that can be employed, as well as limiting the variety of lighting effects that can be produced. The known track lighting fixtures often are able to operate with only a limited number of types of light sources; many of the known fixtures, for example, are not capable of operating with certain types of high-intensity light sources. It is also difficult in the known track lighting fixtures to reaim or redirect the fixture after its initial installation without requiring an individual to climb upon a chair or ladder to reach and move the fixture, which may lead to an accident.

BRIEF DESCRIPTION OF THE INVENTION

It is an object of the present invention to provide a track lighting fixture with which a number of different lamp holders may be assembled from a minimum number of components.

It is a further and related object of the invention to provide a track lighting fixture which can accommodate a variety of lamp holders of different configurations and shapes, and that can operate with different light sources including high-intensity discharge lamps.

It is a further object of the present invention to provide a track lighting fixture which can be more readily and safely reaimed or adjusted.

To these ends, the track lighting fixture of the invention includes a receptacle that can be used with a wide variety of lamp enclosures of different configurations and sizes. The fixture includes an L-shaped bracket adapted to be pivotably mounted by means of a stem and a track adapter to a track. The fixture further includes a lamp socket in its interior and a docking bulkhead at one end having a support that includes a bayonet mount that receives a mating bayonet mount in the mounting end of the lamp enclosure.

Various shapes, sizes and colors of lamp enclosures may be mounted to the fixture of the invention by inserting the bayonet mount of the lamp enclosure into the bulkhead bayonet mount and rotating the lamp enclosure through a specified angle with respect to the fixture holder, thereby to securely lock the lamp enclosure to the fixture.

In another aspect of the invention, an opening is provided in the opposing end of the L-shaped bracket through which the end of a hand-held pole may be inserted to grip the fixture, so that by manipulation of the pole the angle and horizontal attitude of the fixture can be accurately adjusted by an individual from the floor without the need for that individual to risk injury by standing on a chair or ladder.

In a further aspect of the present invention, a ballast enclosure or holder may be secured to the fixture bracket to allow a ballast or transformer to be electrically connected to the fixture lamp socket to provide operating voltage and current to the light source mounted therein. The mounting of a transformer or ballast in this manner allows the fixture to operate with a variety of different light sources, which include incandescent, fluorescent, and high-intensity discharge lamps.

DESCRIPTION OF THE DRAWINGS

To the accomplishment of the above, and to such further objects as may hereinafter appear, the present invention relates to a track lighting fixture substantially as defined in the appended claims and as described in the following detailed description of a preferred embodiment as combined with the accompanying drawings, in which:

DETAILED DESCRIPTION OF THE PREFERRED EMBODIMENTS

Figure 1:
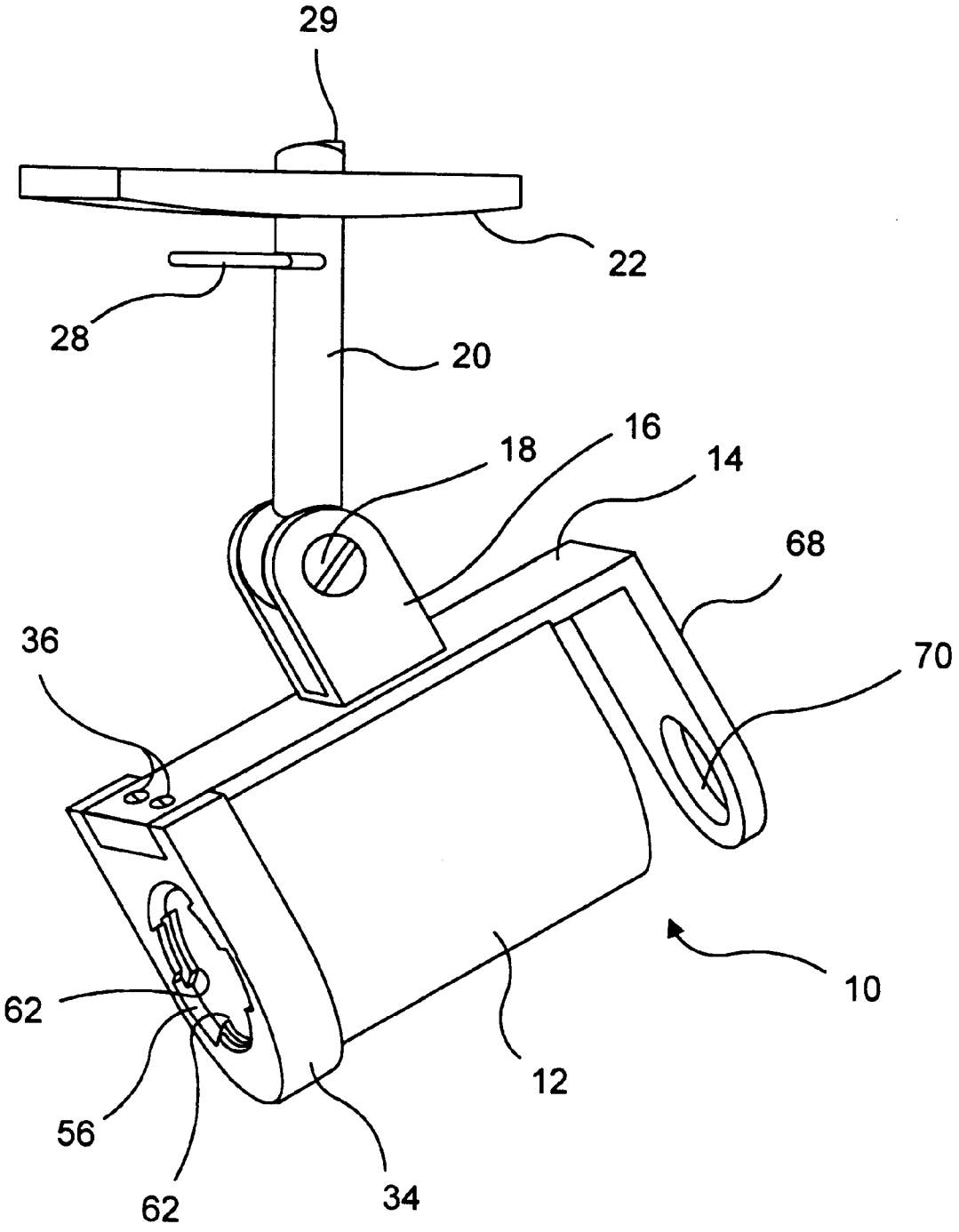
FIG. 1 is a perspective of a track lighting fixture in accordance with an embodiment of the invention.

In the embodiment of the invention shown in FIG. 1, a track lighting fixture generally designated 10 includes a U-shaped cover or housing 12 secured at its upper end to an L-shaped bracket 14. Integral with bracket 14 is a vertical mounting bracket 16, which is pivotably mounted by means of a pin 18 to the lower end of a mounting stem 20. A track adapter 22 including a electrical contact 24 is secured to the upper end of stem 20 and is inserted and mounted to a ceiling track 26 (FIG. 2) by the operation of a latching lever arm 28 in a conventional manner to mechanically secure fixture 10 to the ceiling track and to make the required electrical connection between the fixture and the track power line. As seen best in FIG. 3, housing 12 includes a rear wall 30 having an opening 32 formed centrally therein. A U-shaped docking bulkhead or shade support 34 is secured at its upper end to the inner end of bracket 14 by any suitable means such as a screw 36.

A mounting plate 38 is secured to the transverse wall 40 of bracket 14, by means of a screw 49. Mounting plate 38 includes a vertical wall 42 that extends downwardly within the interior of housing 12. A threaded lamp socket 44 is mounted at its inner end to wall 42 and is supported thereby. A latch spring 46, which retains cover 12 to the bracket 14, includes an arm 48 interposed between the transverse wall 50 of mounting plate 38 and transverse wall 40 of mounting bracket 14. Latch spring 46 is also secured to wall 40 of bracket 14 by screw 49. An arm 52 of latch spring 46 extends downwardly and engages the inner surface of wall 30 of cover 12. Arm 52 includes a finger 54 that extends through opening 32 and engages wall 30 at that location. Shade support 34 includes a lower circular flange 35 which supports the front end of housing 12, and a circular opening 56 through which passes the threaded base of 58 of lamp 60 to engage the threaded bore of lamp socket 44.

Figures 3, 4:
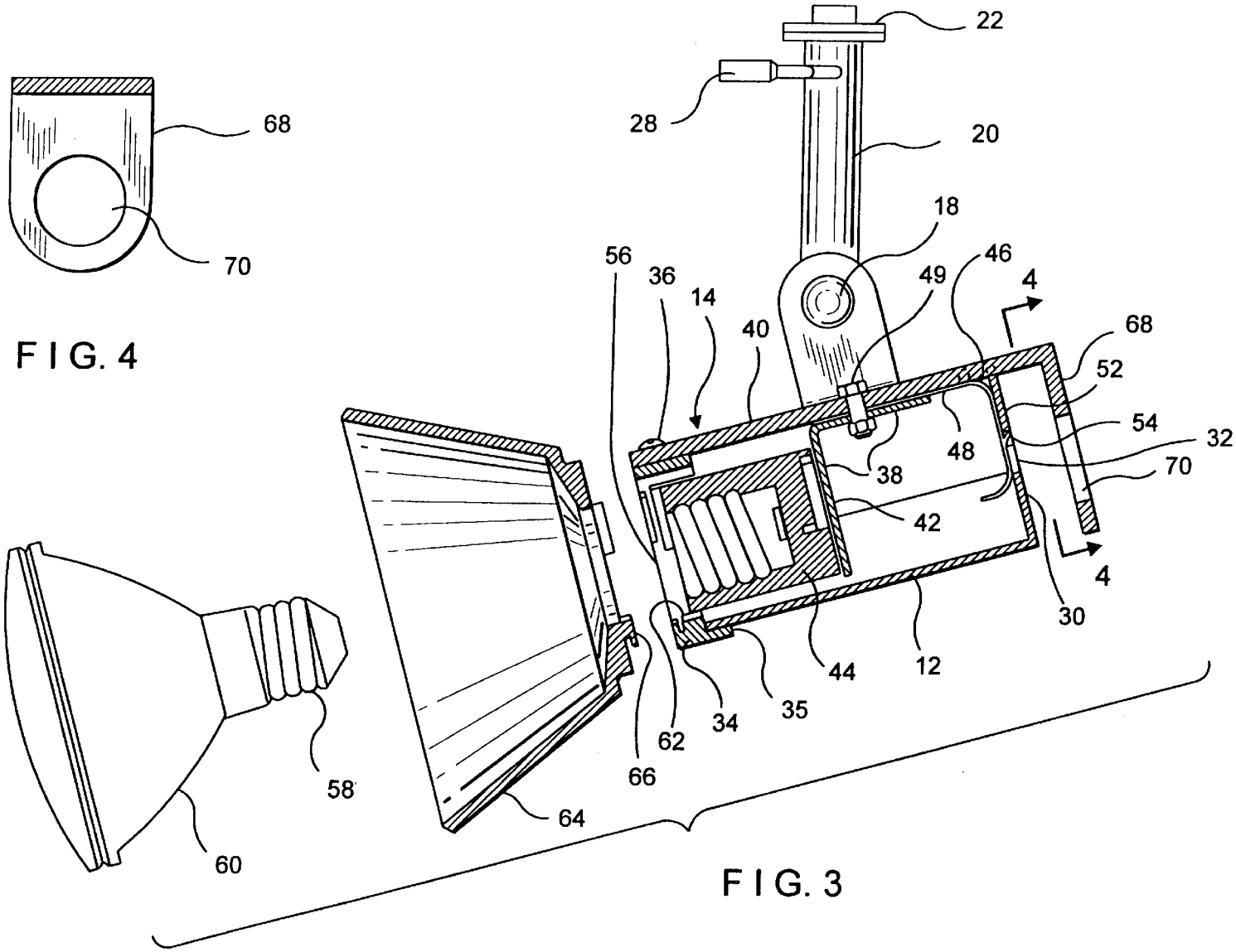
FIG. 3 is an exploded side elevation, partly in cross-section, of the track lighting fixture of FIG. 1.
FIG. 4 is an elevation as viewed in the direction of the arrows 4—4 in FIG. 3.
Figure 5:
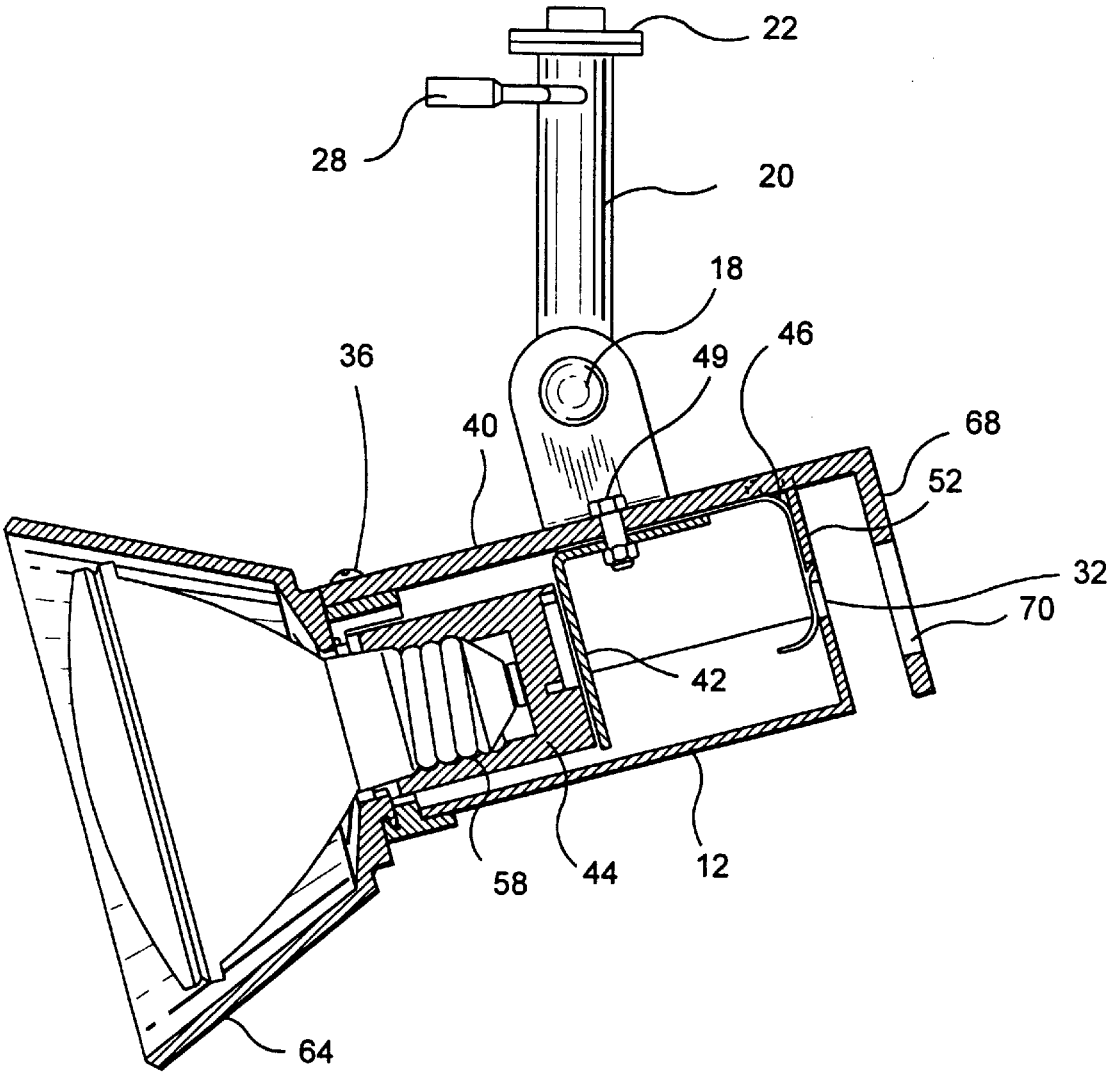
FIG. 5 is an elevation, partly in cross-section, of an assembled track lighting fixture of the invention.
Figure 6:
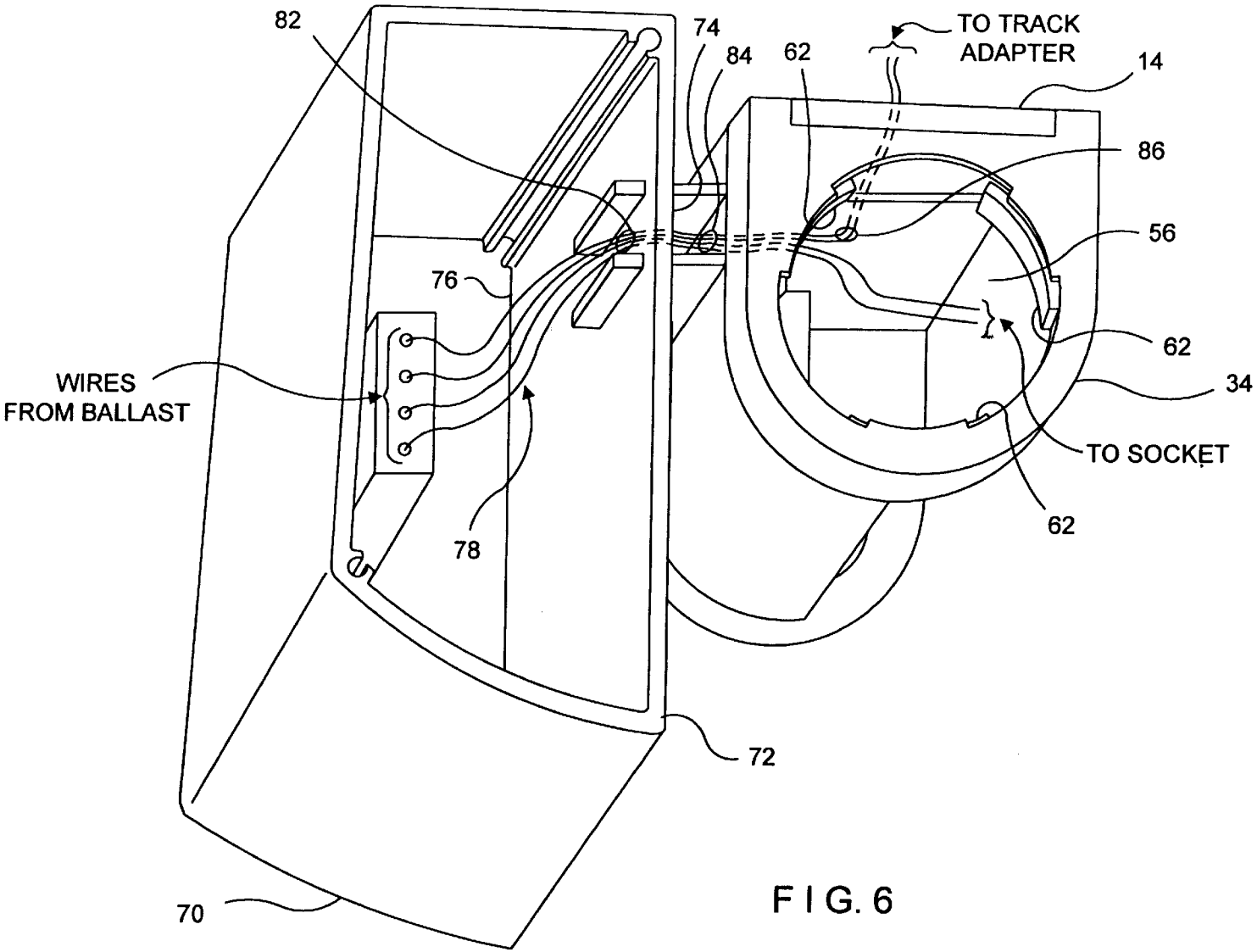
FIG. 6 is a perspective illustrating the manner in which a ballast holder may be secured to the track lighting fixture of the invention.

As shown best in FIGS. 3 and 6, a female bayonet receptacle 62 is formed about the circumference of opening 56 of shade support 34. The inner end of a lamp enclosure or shade 64 is configured with a mating bayonet mount 66, which is received in opening 56 of the shade support 34, and rotated within the bayonet receptacle 62 through an angle, preferably about 30°, thereby to securely lock the enclosure 64 within the open end of the fixture.

Lamp enclosures of various shapes, sizes and colors that have a bayonet mount at their insertion end can be similarly accommodated within the fixture 10 simply by inserting and rotating the enclosure's bayonet mount into the open end of the fixture so that the enclosure bayonet mount tightly engages the fixture bayonet receptacle. In addition, filters of various colors and textures (not shown) may be mounted and secured to the outer end of the enclosure 64 to achieve a variety of color combinations to satisfy the requirements of the lighting designer. As described in greater detail below with reference to FIG. 6, a pair of holes are provided in the fixture housing to receive wires from auxiliary devices such as a transformer or ballast, to provide the level of current and voltage required to operate lamps such as HID, low voltage and fluorescent lamps.

Figure 2:
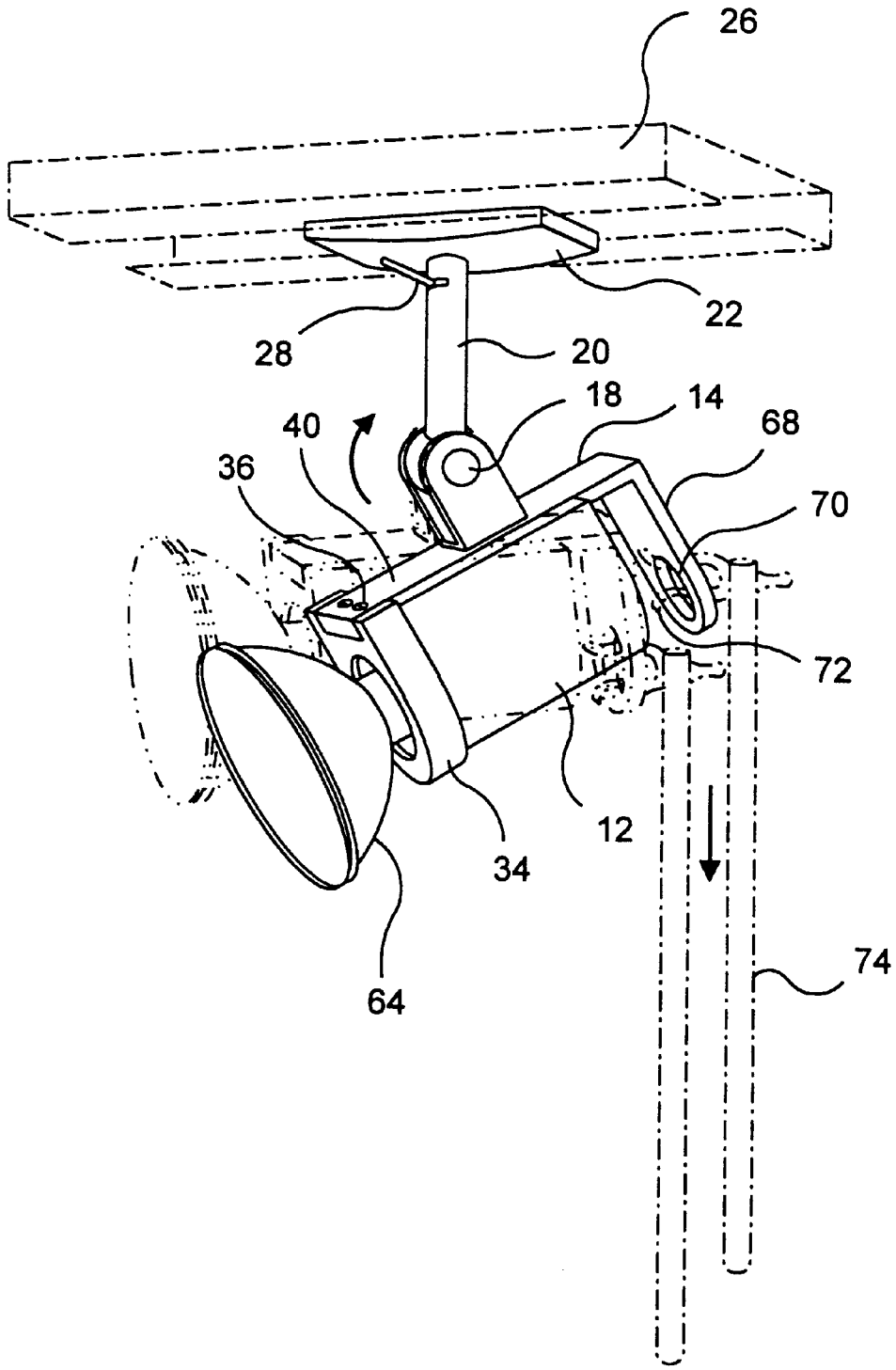
FIG. 2 is a perspective of the track lighting fixture of the invention in the assembled condition, and illustrating in broken lines how the fixture may be reaimed or repositioned.

Referring to FIGS. 3 and 4, the rear wall 68 of bracket 14 includes an off-center opening 70. As seen best in FIG. 2, the purpose of this opening is to allow the fixture 10, after it has been secured to a track and placed at a desired angular relationship to the track, to be readily reaimed or readjusted. To reaim the fixture, as shown in FIG. 2, a nonmarring rubber tip 72 attached to the upper end of a long pole 74, which is held by a person who wishes to reaim the fixture, is passed through opening 70 to engage the rear wall of bracket 14. Movement of the pole 74 after this engagement causes the fixture 10 to pivot or swivel about pin 18 in swivel assembly 16, thereby to cause the fixture 10 to be reaimed, such as to the position shown in broken lines in FIG. 2.

FIG. 6 illustrates the manner in which an enclosure 90 may be mounted to the fixture 10 for supporting a ballast or transformer that provides the appropriate operating voltage and current to the lamp in fixture 10. As shown in FIG. 6, enclosure 90 may house or mount a transformer or a ballast 80 depending on the type of lamp in the fixture. Enclosure 90 includes a side wall 72 in which slots are formed. Mounting plates 76 that may be secured to, or extend from wall 40 of bracket 14 extend through slots 74 into the interior of enclosure 90 where they may be swaged, for example, to secure enclosure 90 to plates 76 and thus to the fixture 10.

Wires 78 from the ballast 80 are passed through aligned openings 82 and 84 in enclosure 90 and housing 12, respectively. Two of those wires make electrical contact with lamp socket 44 in the interior of the fixture, thereby to supply the required operating voltage and current to the lamp, and the two other wires extend through an opening 86 in bracket 14 to make electrical contact with the track adapter 22, thereby to receive the ac supply voltage. Enclosure 90 may also be used to mount other electrical components that can provide control of the voltage and/or current applied to the lamp within the fixture such as switches, dimmers and light-level sensors that can, depending on the level of sensed ambient light, automatically turn the light on or off.

It will be appreciated from the foregoing description of a preferred embodiment that the lighting fixture of the invention is able to receive a wide variety of lighting sources and enclosures, and can also be readily reaimed without requiring the individual to stand on a ladder or chair. It will also be appreciated that although the fixture of the invention has been described hereinabove with respect to a presently preferred embodiment, modification can be made thereto without necessarily departing from the spirit and scope of the invention.

What is claimed is:

1. A lighting fixture comprising a mounting stem, a mounting bracket pivotably mounted to the lower end of said mounting stem, a lamp support member secured to the front end of said mounting bracket, a cover secured at its upper end to said mounting bracket and extending rearward from said lamp support member, and a lamp socket in the interior of said cover and secured to said mounting bracket, said lamp support including an opening axially aligned with said lamp socket and including a bayonet mount provided about its perimeter for receiving a mating bayonet mount of a lamp holder.

2. The lighting fixture of claim 1, in which said mounting bracket further includes an arm extending downwardly from its rear end having an opening therethrough for receiving the end of a pole, whereby said fixture may be reaimed by movement of the pole when its end is received within said opening.

3. The fixture of claim 1, further comprising a ballast or transformer holder secured to said mounting bracket for holding a ballast or transformer to provide operating current and voltage to a lamp contained within said lamp socket.

* * * * *